US005325087A

United States Patent [19]

Mikli

[11] Patent Number: 5,325,087

[45] Date of Patent: Jun. 28, 1994

[54] ELECTRICAL PROTECTION APPARATUS

[75] Inventor: Norbert Mikli, Ebersberg, Fed. Rep. of Germany

[73] Assignee: Raychem GmbH, Fed. Rep. of Germany

[21] Appl. No.: 927,513

[22] PCT Filed: Mar. 15, 1991

[86] PCT No.: PCT/GB91/00405

§ 371 Date: Sep. 15, 1992

§ 102(e) Date: Sep. 15, 1992

[87] PCT Pub. No.: WO91/14304

PCT Pub. Date: Sep. 19, 1991

[30] Foreign Application Priority Data

Mar. 15, 1990 [GB] United Kingdom ..... 9005827

[51] Int. Cl.[5] ..... G08B 21/00

[52] U.S. Cl. ..... 340/635; 340/653; 361/118; 250/227.15; 385/13

[58] Field of Search ..... 340/635, 653; 361/111, 361/117, 118; 250/227.15, 227.16; 385/13

[56] References Cited

U.S. PATENT DOCUMENTS 4,298,794 11/1981 Snizer et al. ..... 250/227
4,307,607 12/1981 Saaski et al. ..... 73/356
4,532,499 7/1985 Collin ..... 340/644
4,840,480 6/1989 Starke et al. ..... 386/32

FOREIGN PATENT DOCUMENTS 0036760 9/1981 European Pat. Off. .
2081535 2/1982 United Kingdom .
2124784A 2/1984 United Kingdom .
2203832A 10/1988 United Kingdom .

OTHER PUBLICATIONS

Patent Abstract of Japan vol. 13, No. 386 (E-812) (3734) Aug. 25, 1989, & Jp-A-1 136305 (Mitsubishi Electric Corp.) May 29, 1989 [plus unofficial translation].

*Primary Examiner*—Jeffery A. Hofsass
*Attorney, Agent, or Firm*—Herbert G. Burkard; A. Stephen Zavell

[57] ABSTRACT

A surge arrester 2 comprises eight surge arresting varistor blocks 4 stacked within a polymeric outer insulating housing 14. A fibre optic cable 16 is fed into the surge arrester 2 through one end electrode 6, helically wound around all the blocks 4 in good thermal contact therewith and exits through the same electrode 6. A monitoring arrangement 18 compares the light incident on and emergent from the optical cable 16 to determine its integrity and thus the integrity of the surge arrester 2.

7 Claims, 1 Drawing Sheet

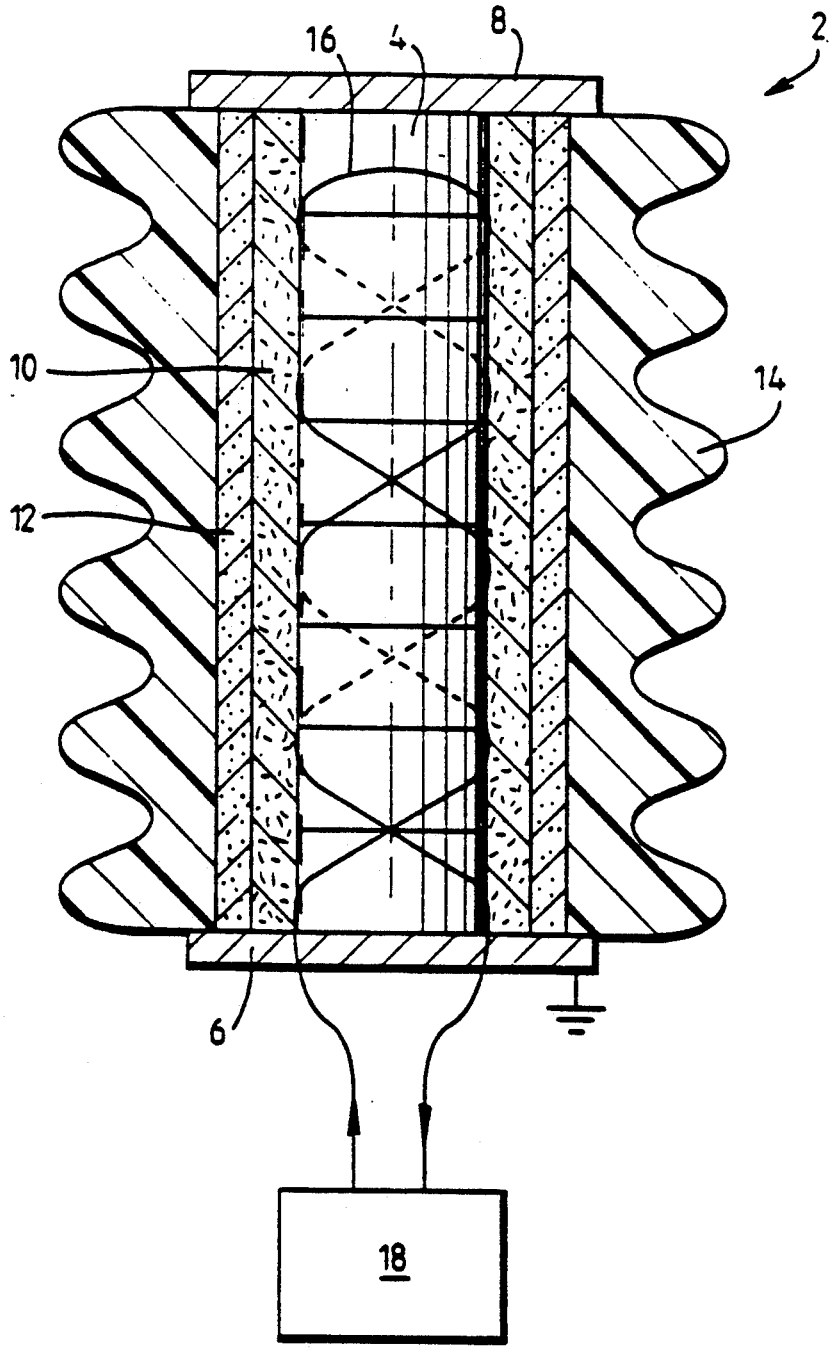
16
4
8
2
10
14
12
6
18

ELECTRICAL PROTECTION APPARATUS

DESCRIPTION

This invention relates primarily to surge arresters, but is also applicable to transformers, switches, insulators, and cable terminations and splices.

Surge arresters are connected to electrical power equipment, such as transformers, switchgears and overhead conductors, in order safely to divert to earth any excess current that would otherwise flow through and damage the equipment. Such excess current could arise, for example, from a lightning strike. Surge arresters typically comprise one or more surge arresting elements for example varistors made of a metal oxide such as zinc oxide, and/or silicon carbide material and/or a spark gap, and a plurality of such elements are usually mounted end-to-end in a linear stack, being urged together and into good electrical contact with a pair of end electrodes by one or more conductive springs. The stack of surge arresting elements is encased within an outer insulating housing that provides mechanical strength and that protects the elements electrically and also against adverse environmental conditions. The outer housing may be made of porcelain or of an insulating and substantially non-tracking polymeric material, which may be recoverable, for example by the application of heat thereto. The surge arresting elements may be encased in a reinforced resin to enhance the physical and electrical protective thereof, before the outer housing is positioned thereon. Examples of such surge arresters are disclosed in U.S. Pat. No. 4,812,944, GB-A-2073965, GB-A-2188199, U.S. Pat. No. 4,262,318, U.S. Pat. No. 4,656,555, U.S. Pat. No. 4,495,381, and U.S. Pat. No. 4,335,417.

When surge arresters operate, that is to say when they switch from their normally insulating mode to a conducting mode, the high current that flows therethrough creates large mechanical forces and generates a large quantity of heat, and such an environment is preferably withstood by the mechanical protection applied to the surge arresting elements. In some cases, however, the current flow may not be so severe as to produce externally-visible damage yet the surge arresting elements may still be significantly damaged, that is to say damaged to an extent that would impair subsequent operation of the arrester, with the possibility of the associated equipment then not being properly protected.

Japanese Patent Publication No. 1-136305 discloses a surge arrester in which a single plastics optical fibre is introduced through and exits from a metal cover or electrode at one end of a plurality of surge arresting elements that are mounted within and radially spaced from a porcelain outer insulating housing. Within the housing, the optical fibre is looped in heat-transferable manner around one of the elements located towards said one end of the arrester, which element is said to be characteristic of the plurality of elements. Light incident on the optical fibre is compared with light emergent therefrom, and any difference therebetween is monitored and taken to be indicative of heating of the surge arresting elements. Should such difference exceed a predetermined value, then electrical breakdown of the surge arrester can occur.

It is one object of the present invention to provide an improved surge arrester whose internal integrity can be monitored externally thereof in a convenient manner without the surge arrester having to be dismantled.

In accordance with one aspect of the present invention, there is provided a surge arrester comprising a plurality of surge arresting elements mounted within a protective housing, wherein an optical fibre arrangement is disposed within the housing so as to be in good thermal contact with substantially all of said elements thereby to provide an indication of damage to the surge arresting elements.

Thus, in contrast with JP 1-136305, the present invention requires thermal contact of optical fibres not with a single characteristic surge arresting element, but with substantially all, usually all, of them. This is because the characteristics of these elements, usually metal oxide varistor blocks, can vary from one element to another. Thus, any current that does flow through them as earth leakage current in their normal insulating state can give rise to quite different amounts of heating in different blocks. When the weakest of the blocks fails, the surge arrester as a whole can fail. The optical fibre arrangement is thus disposed such that significant damage to any one of the elements results in detectable damage to optical transmission, and for example physical breakage, of the optical fibre arrangement.

Interrogation of the optical fibre arrangement to determine its integrity or any deterioration thereof is taken to indicate the integrity or possible pending deterioration also of the associated surge arresting elements. The generation of heat within the surge arrester due to the passage of an electric arc therethrough may be sufficient to destroy at least part of the optical fibre arrangement.

Advantageously the optical fibre arrangement is bonded directly to the surge arresting elements so as to form an integral structure therewith, for example by being encased within a resin, adhesive or mastic that envelopes the surge arresting elements.

Advantageously, the optical fibre arrangement comprises a large number, more than 50, preferably more than 100, and most preferably about 200, of optical fibres. These are usually encased within a single outer protective sheath, which may be of polymeric material. For best monitoring of the surge arresting elements, it is preferred to remove the outer sheath from that portion of the bundle of optical fibres within the surge arrester housing, and to spread them out laterally, to form a track width of the order of 1 cm. In this way, the bundle can be spirally would around the stack of arrester blocks so as to cover a very large proportion, more than half, of the circumferential surfaces of all, or substantially all, of the blocks.

Whilst it is preferred, for reasons given above, to monitor all of the surge arresting elements by direct contact therewith, in surge arresters having a large number of blocks it is envisaged that exceptionally a very small minority of them may not be so monitored. In such a case, however, it should be ensured that any element not so monitored is in good thermal contact with at least one element that is monitored.

Because of the high temperatures that can be reached within surge arresters, even under conditions in which they are not damaged, it is preferred that the optical fibres be of glass rather than plastics material.

When the construction of the surge arrester is such that a hollow channel extends along the surge arresting elements, for example axially of an elongate surge arrester, then the optical fibre arrangement may be located therein, preferably in physical contact with the surge arresting elements. However, when a completely enclosed construction is employed, the optical fibre arrangement may be located laterally between the surge arresting elements and the outer protective housing, for example extending along an annular region therebetween. Preferably, however, the optical fibres are helically would around the stack of elements between the two ends of the surge arrester. In an alternative construction, the surge arresting elements may be enclosed within an insulating sheath, for example of glass-fibre reinforced resin, for structural rigidity, with the optical fibre arrangement being disposed around the outside of that sheath.

The outer component of the surge arrester is an insulating housing, preferably of polymeric material and advantageously recovered from a larger diameter into close conformity with the inner components of the arrester. Alternatively, the outer housing may be made of porcelain.

Since the two ends of the surge arrester, when connected to electrical equipment in use, will be at significantly different electrical potentials, one end being earthed and the other end at the line voltage of, say, 15 kV or higher, preferably the optical fibre arrangement extends within the, usually elongate, housing away from one end thereof, advantageously the end at, or closer to, earth potential, towards the other end, so as to be associated with the whole length of the surge arresting elements, and back towards the one end. In this way, there is no, or very little, potential difference between the two ends of the optical fibre arrangement. The optical fibre arrangement may extend at each of its ends beyond the housing of the surge arrester at one end thereof, for example to a monitoring arrangement that may be located spaced apart from but close to the surge arrester or, alternatively, remote therefrom. Alternatively, both ends of the optical fibre arrangement may be terminated substantially at one end of the housing. In this latter configuration, it is envisaged that a monitoring arrangement may be connected to the optical fibre arrangement locally, or remotely by means of a suitable interconnecting arrangement, which may be another optical fibre arrangement.

The optical fibre arrangement may comprise one or more optical fibres, and in the case of more than one fibre they may be grouped into one or more bundles of fibres, which may follow the same path or different paths through the surge arrester. A bundle of optical fibres may be splayed out for better conformity with the surge arresting elements and/or with the protective housing. Typically, the optical fibre arrangement would be arranged to transmit electromagnetic radiation in the visible part of the spectrum, but it is envisaged that other parts, for example at microwave frequencies, may be employed, using a suitable construction of the optical fibres. For convenience herein, the term "light" will be used generically for all such radiation transmitted by the optical fibre arrangement.

The surge arrester preferably also comprises a monitoring arrangement that is arranged to pass light into one end of the optical fibre arrangement and to detect any light consequently emitted by the other end thereof. The monitoring arrangement may be arranged permanently to monitor the optical fibre arrangement, either locally or remotely, or may be arranged to do so intermittently in a predetermined manner or on demand. A plurality of optical fibre arrangements or a plurality of surge arresters may have respective monitoring arrangements associated therewith, or they may be multiplexed through a single monitoring arrangement. The light source of the monitoring arrangement may comprise any suitable source, such as a light-emitting diode, or a laser. The light generated by the monitoring arrangement may be continuous, but advantageously it is pulsed, since discrimination can then be obtained from any constant background light that could enter into the optical fibre or monitoring arrangements. For example, it is conceivable that the protective housing of the surge arrester may be ruptured or even completely destroyed by a current surge passing through the surge arresting elements, resulting in the optical fibre arrangement being severed; sunlight could then enter the return portion of the optical fibre member, leading to a false reading of integrity by the monitoring arrangement. Pulsed input light would thus enhance the reliability of the monitoring.

The surge arrester may have surge arresting elements and a protective housing of any suitable form, and may for example be as hereinbefore described with reference to known surge arresters.

In another aspect, the present invention provides a method of monitoring the integrity of a surge arrester using an optical fibre arrangement. The method may entail the use of apparatus and techniques hereinbefore described with respect to the surge arrester of the invention.

Although the invention is described primarily with respect to a surge arrester, it is envisaged that the present invention also relates to, and encompasses, other electrical apparatus, such as voltage- and current-transformers, switches, insulators and cable terminations and splices for example, where an optical fibre arrangement may be arranged as hereinbefore described to indicate damage to that apparatus. In particular, electrical apparatus, including those just mentioned, having an enveloping housing and that internally thereof is subject to damage that is not necessarily visible externally thereof, could advantageously be provided with an optical fibre arrangement for ascertaining its integrity.

Thus, in accordance with a further aspect of the present invention, there is provided electrical apparatus comprising an electrical element mounted within an elongate protective housing, wherein an optical fibre arrangement is disposed within the housing in good thermal contact with substantially the whole of the electrical element thereby to provide an indication as to whether damage has occurred to the electrical element, the optical fibre arrangement extending within the housing away from one end thereof, towards the other end, and back towards the one end such that the optical fibre arrangement, in use, is at substantially the same electrical potential on entering and on leaving the protective housing.

In this further aspect, the electrical element may comprise, for example, electrical contacts of a transformer or switch, or the conductor or insulation of a cable. It will be appreciated that many aspects of the optical fibre arrangement, its mounting and its monitoring as herein discussed specifically with respect to a surge arrester, are also applicable to the other electrical apparatus, either directly or with such modification as would be obvious to one skilled in the art.

A surge arrester and its method of monitoring, each in accordance with the present invention, will now be described by way of example with reference to the accompanying drawing, which schematically shows the surge arrester in side elevation partially in section.

Referring to the drawing, the surge arrester 2 comprises eight generally cylindrical zinc oxide varistor elements 4 stacked end-to-end in good electrical contact with and between a pair of metal end electrodes 6,8. The varistors 4 are completely circumferentially encased within a glass fibre reinforced cured epoxy resin material 10, and this is enclosed within a mastic layer 12. A polymeric electrically insulating and non-tracking tubular housing 14 that is externally shedded closely contains the elements 4, resin 10 and mastic 12. An optical fibre cable 16 of diameter approximately 2 mm passes into the housing 14 through the end electrode 6 that in use is maintained at earth potential, extends in generally spiral fashion around and along the stack of varistor elements 4 towards the other end electrode 8, that in use is maintained at a high voltage of 36 kV, and then back towards the earthed electrode 6, through which it exits the housing 14. The optical fibre cable 16 is embedded within the resin 10 in good thermal contact with each of the varistors 4 throughout its length within the housing 14.

The optical fibre cable 16 comprises an outer polymeric jacket and about 200 glass optical fibres contained as a bundle therein. The cable jacket is removed from its portion within the housing 14, and the individual fibres splayed out to form a track about 1.0 cm wide in its path through the surge arrester in contact with the varistor blocks 4.

The surge arrester 2 may be mounted on a support pylon (not shown) of a high voltage overhead power cable transmission system, with the lower electrode 6 connected to the pylon at earth potential, and the upper electrode 8 connected to the power cable at high voltage.

A monitoring arrangement 18, which may be located locally towards the bottom of the support pylon, or alternatively could be mounted directly on to the earthed surge arrester electrode 6, or remotely from the surge arrester 2, is arrange to send pulsed visible light along the optical fibre cable 16 within the surge arrester 2 and to detect the light output therefrom. If unattenuated output light is detected, then it is assumed that the integrity of the surge arrester 2 has not been disturbed. If no output light, or light attenuated beyond a predetermined level, is received by the monitoring arrangement 18, then it is assumed that the surge arrester 2, or at least one of its surge arresting varistor elements 4, has been damaged, for example by the passage of surge current therethrough, so that appropriate corrective action can then be taken. It is to be understood, of course, that the damage could arise from other sources, for example vandalism, which would also be detected by the monitoring arrangement.

I claim:

1. A surge arrester comprising:

(a) a plurality of surge arresting elements mounted within a protective housing; and (b) an optical fibre arrangement disposed within the housing;

wherein (c) the optical fibre arrangement comprises a plurality of optical fibres that are splayed out and helically wound around substantially all of the surge arresting elements in good thermal contact therewith, and (d) said optical fibre arrangement is arranged to provide an indication of damage to the surge arresting elements.

2. A surge arrester according to claim 1 wherein the optical fibre arrangement is bonded to the surge arresting elements.

3. A surge arrester according to claim 1 wherein the optical fibre arrangement is disposed within the housing such that any significant damage to at least one of the surge arresting elements results in breakage of the optical fibre arrangement.

4. A surge arrester according to claim 1, of generally elongated configuration, wherein the optical fibre arrangement extends within the housing away from one end thereof towards the other end and back towards the one end.

5. A surge arrester according to claim 1, comprising a monitoring arrangement, in which the monitoring arrangement is arranged to pass light into the optical fibre arrangement and to detect any light consequently emitted thereby.

6. A surge arrester according to claim 1, wherein the optical fibre arrangement is in good thermal contact with each one of the surge arresting elements.

7. Electrical apparatus comprising:

an elongated protective housing;

a plurality of electrical elements, said elements being mounted in said housing; and an optical fiber arrangement;

in which:

said optical fibre arrangement is disposed within the housing in good thermal contact with the plurality of electrical elements and is arranged to provide an indication as to whether damage has occurred to the electrical elements; and the optical fiber arrangement extends within the housing away from one end thereof, towards the other end, and backwards towards one end such that the optical fiber arrangement, in use, is of substantially the same electrical potential on entering and on leaving the protective housing.

* * * * *